US005293826A

United States Patent [19]

Perez

[11] Patent Number: 5,293,826

[45] Date of Patent: Mar. 15, 1994

[54] BEDSIDE TABLE APPARATUS

[76] Inventor: Cheryl A. Perez, 2025 Lot 44 Northwind Dr., Junction City, Kans. 66441

[21] Appl. No.: 982,907

[22] Filed: Nov. 30, 1992

[51] Int. Cl.[5] ..... A47B 23/00

[52] U.S. Cl. ..... 108/49; 108/134

[58] Field of Search ..... 108/49, 115, 134, 152, 108/144, 9, 6

[56] References Cited

U.S. PATENT DOCUMENTS

| | | | |
|---|---|---|---|
| 1,736,354 | 11/1929 | Morin | 108/134 |
| 3,054,122 | 9/1962 | Sarkus | 108/49 |
| 3,543,312 | 12/1970 | Pofferi | 108/49 |
| 4,286,525 | 9/1981 | Willmore | 108/49 |
| 4,910,816 | 3/1990 | Lansing | 5/604 |
| 4,938,153 | 7/1990 | Maes | 108/6 |
| 5,022,327 | 6/1991 | Solomon | 108/144 |
| 5,211,456 | 5/1993 | Staffaroni | 108/134 |

*Primary Examiner*—Kenneth J. Dorner
*Assistant Examiner*—Gerald A. Anderson
*Attorney, Agent, or Firm*—Leon Gilden

[57] ABSTRACT

A bedside table is arranged to include a support base plate arranged for mounting to a side wall of an associated bed, with the support base plate having a bifurcated mount to rotatably position a support plate thereto, with the support plate hingedly mounting a table at an upper distal end of the support plate spaced from the bifurcated mount. The table includes a support link, with the support link pivotally mounted to the table and received through the support plate in a selectively locked manner.

5 Claims, 4 Drawing Sheets

BEDSIDE TABLE APPARATUS

BACKGROUND OF THE INVENTION

1. Field of the Invention

The field of invention relates to bedside table structure, and more particularly pertains to a new and improved bedside table apparatus wherein the same is directed for the mounting of a table structure relative to a bed.

2. Description of the Prior Art

Various support table structure is available in the prior art for positioning various books and the like relative to the bed, as exemplified in U.S. Pat. Nos. 3,543,312; 5,022,327; 4,910,816; 4,938,153; and 4,286,525.

The instant invention attempts to overcome deficiencies of the prior art by providing for a table structure readily and conveniently mounted to a bed structure in a manner not addressed by the prior art and in this respect, the present invention substantially fulfills this need.

SUMMARY OF THE INVENTION

In view of the foregoing disadvantages inherent in the known types of bedside table apparatus now present in the prior art, the present invention provides a bedside table apparatus wherein the same is arranged for mounting to an associated bed assembly. As such, the general purpose of the present invention, which will be described subsequently in greater detail, is to provide a new and improved bedside table apparatus which has all the advantages of the prior art bedside table apparatus and none of the disadvantages.

To attain this, the present invention provides a bedside table arranged to include a support base plate arranged for mounting to a side wall of an associated bed, with the support base plate having a bifurcated amount to rotatably position a support plate thereto, with the support plate hingedly mounting a table at an upper distal end of the support plate spaced from the bifurcated mount. The table includes a support link, with the support link pivotally mounted to the table and received through the support plate in a selectively locked manner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bedside table apparatus which has all the advantages of the prior art bedside table apparatus and none of the disadvantages.

It is another object of the present invention to provide a new and improved bedside table apparatus which may be easily and efficiently manufactured and marketed.

It is a further object of the present invention to provide a new and improved beside table apparatus which is of a durable and reliable construction.

An even further object of the present invention is to provide a new and improved bedside table apparatus which is susceptible of a low cost of manufacture with regard to both materials and labor, and which accordingly is then susceptible of low prices of sale to the consuming public, thereby making such bedside table apparatus economically available to the buying public.

Still yet another object of the present invention is to provide a new and improved bedside table apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
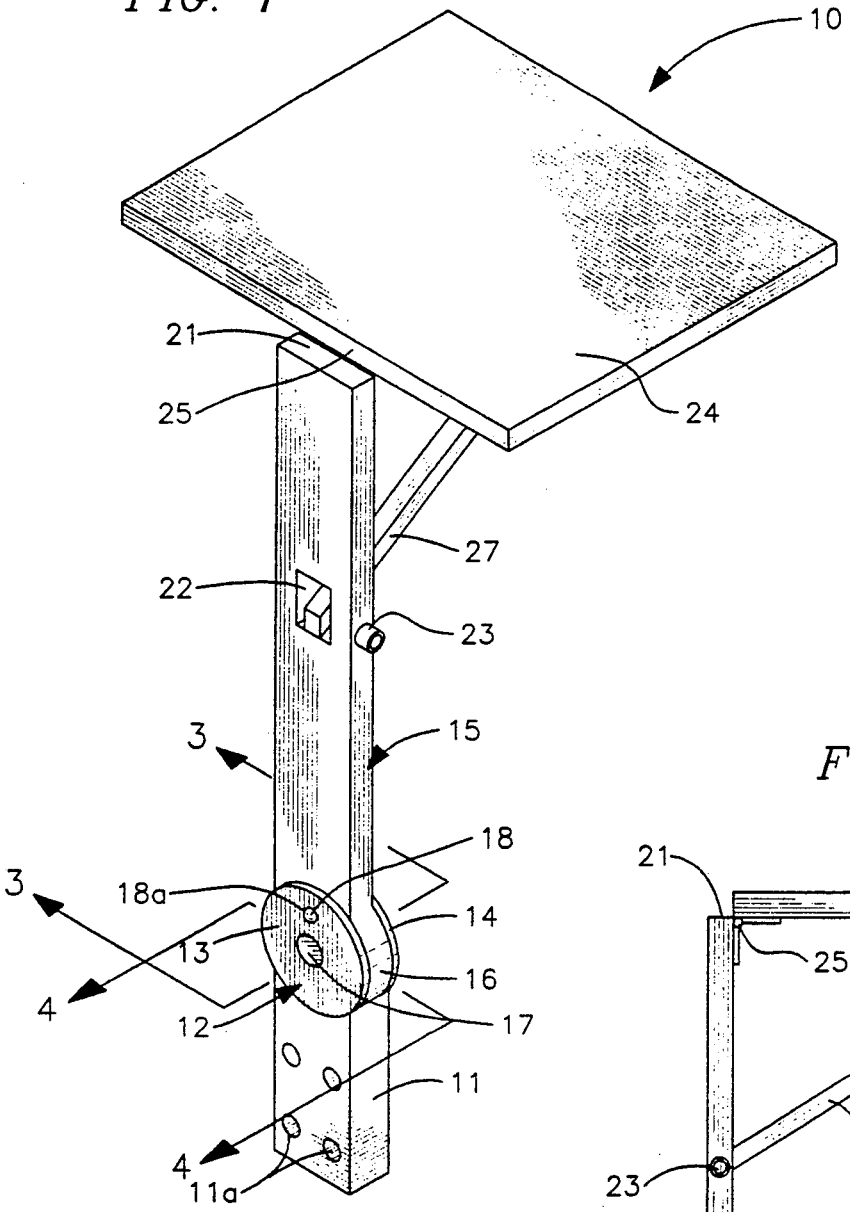
FIG. 1 is an isometric illustration of the invention.
Figure 2:
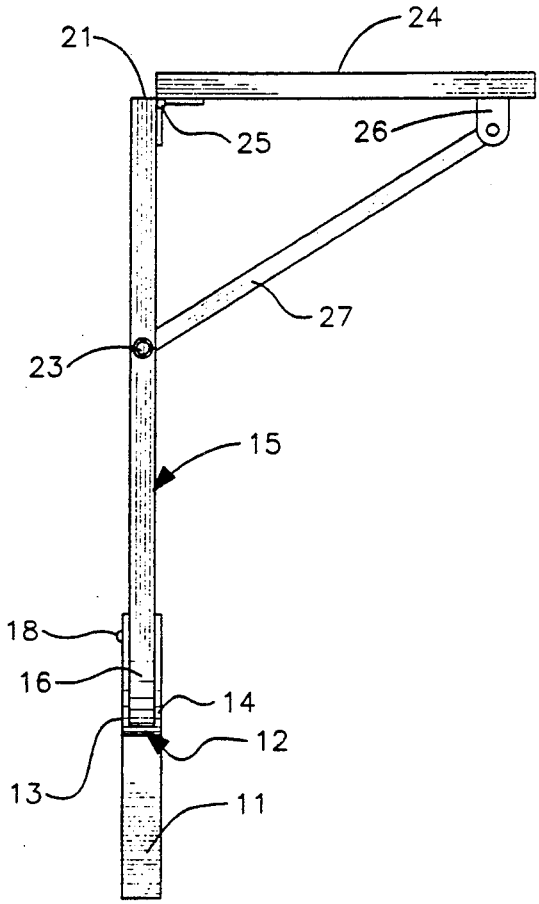
FIG. 2 is an orthographic side view of the invention.
Figure 3:
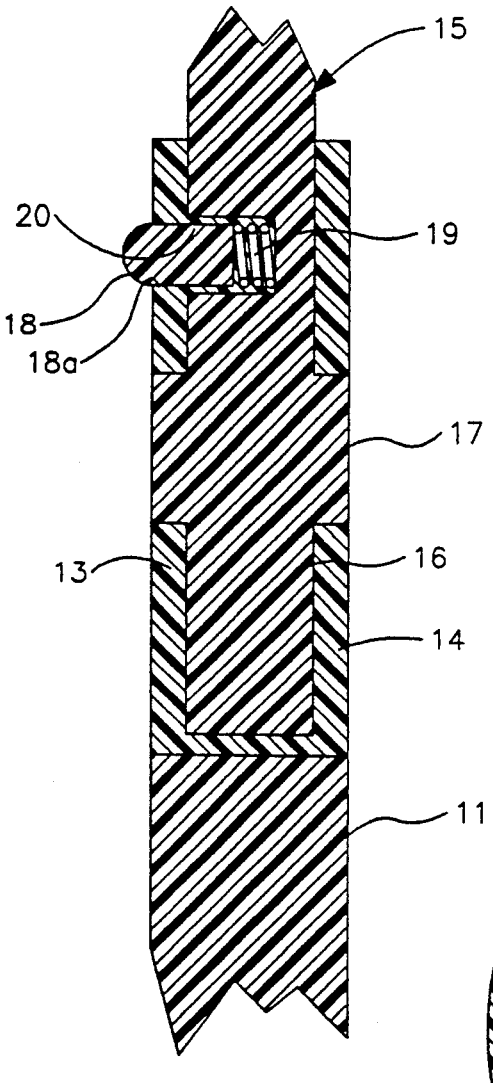
FIG. 3 is an orthographic cross-sectional illustration of the bifurcated mount, mounting the support plate thereto.
Figure 4:
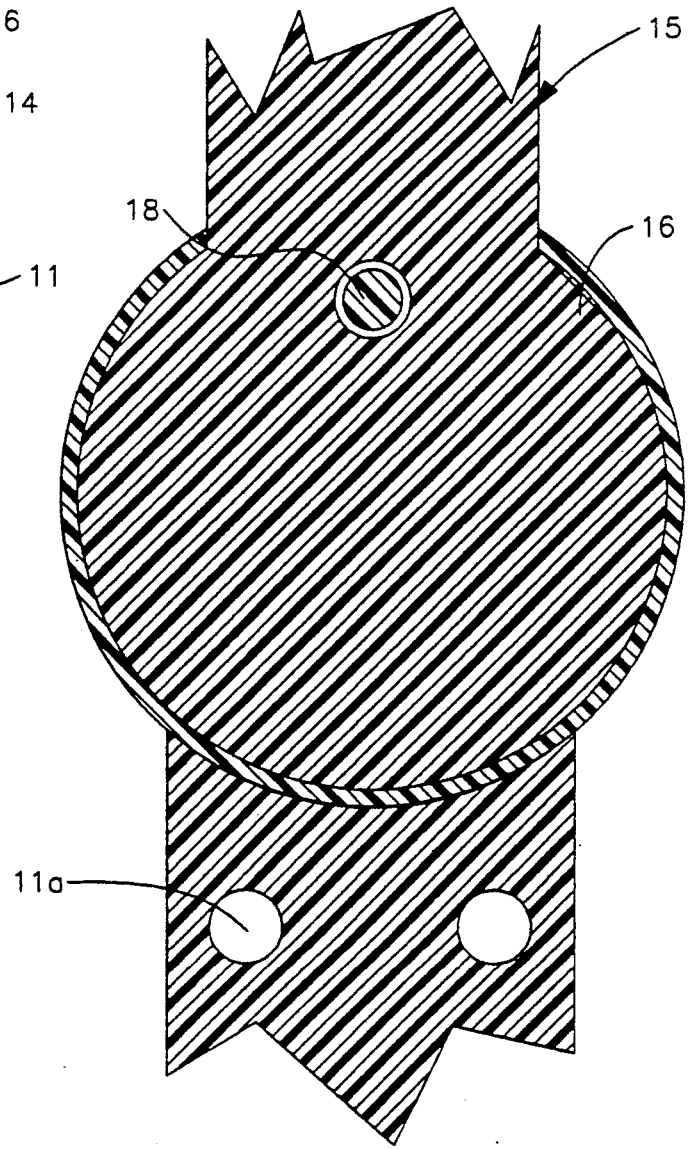
FIG. 4 is an orthographic cross-sectional illustration of the mounting hub of the support plate.

With reference not to the drawings, and in particular to FIGS. 1 to 8 thereof, a new and improved bedside table apparatus embodying the principles and concepts of the present invention and generally designated by the reference numeral 10 will be described.

More specifically, the bedside table apparatus 10 of the instant invention essentially comprises a support base plate 11, having a plurality of base plate mounting bores 11*a* directed therethrough permitting mounting of the base plate 11 to an associated bed rail (not shown) of conventional construction. A bifurcated mount 12 is mounted to an upper distal end of the base plate 11, having a first mounting plate 13 spaced from and parallel a second mounting plate 14, with a support plate 15 having a cylindrical hub 16 mounted at a lower distal end of the support plate 15, with the cylindrical hub 16 pivotally mounted between the first and second mounting plates 13 and 14, and having a hub axle 17 orthogonally directed medially of the first and second mounting plates 13 and 14. A lock pin 18 mounted within a lock pin socket 20 that is directed into the cylindrical hub 16 is in confronting relationship relative to the first mounting plate 13, with a lock pin spring 19 interposed between the lock pin 18 and the socket 20 to bias the lock pin 18 in a projected orientation relative to the socket 20, with the lock pin 18 selectively received through a lock pin bore 18*a* of the first mounting plate 13 to permit fixed securement and alignment of the support plate 15 relative to the base plate 11. In this manner, pivotal displacement of the base plate 11 relative to the support plate 15 is permitted for storage and displacement of the support plate 15 permitting ease of access into and out of an associated bed structure.

The support plate 15 includes a support plate upper end 21 spaced from the lower end of the mounting hub, wherein the support plate upper end includes a support table 24, with the support table 24 having a first side, including a hinge 25 interposed and secured to the support plate first side and to the support plate upper end to pivotally mount the support table relative to the support plate 15. A support plate second side includes a lug 26 mounted to a bottom surface of the support plate in adjacency to the second side, with the lug having a support table link 27. The link 27 includes a link first end pivotally mounted to the lug 26, with a second end received slidably through a support plate bore 22 between the support plate upper end and the support plate lower end. A lock rod 23 is threadedly directed through the support plate intersecting the support plate bore to impinge upon the link 27 to secure the link 27 in a predetermined orientation through the bore 22 providing angulated locking of the support table 24 relative to the support plate 15.

Figure 5:
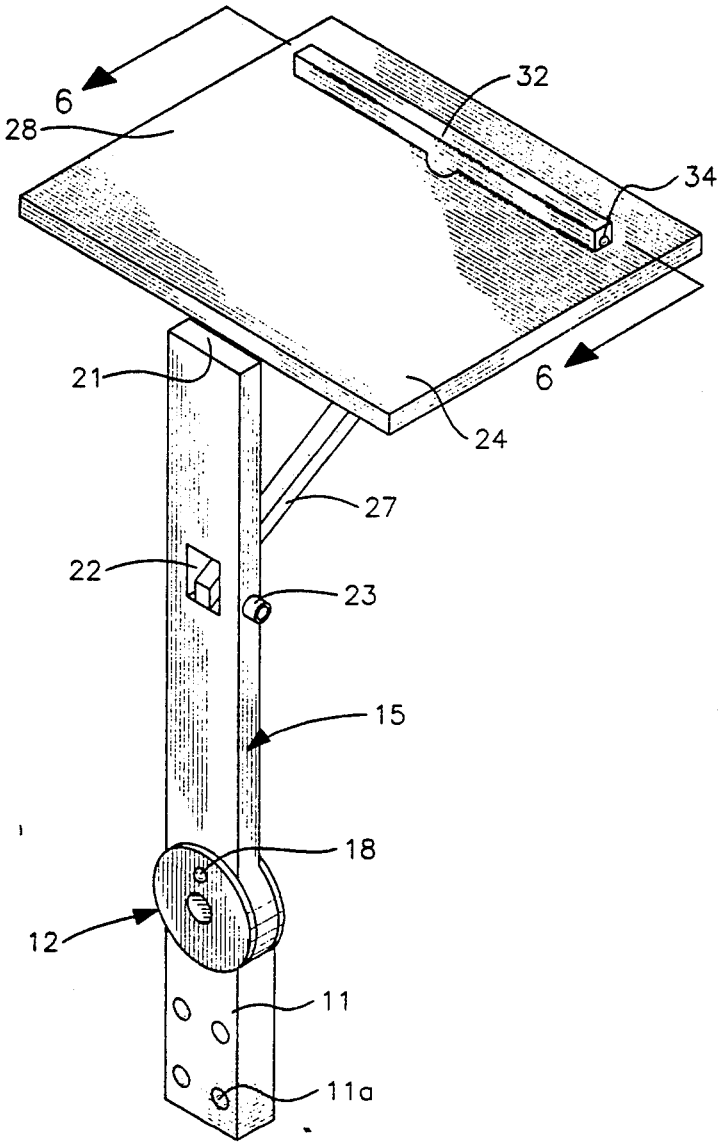
FIG. 5 is an isometric illustration of the invention employing an abutment block.
Figure 6:
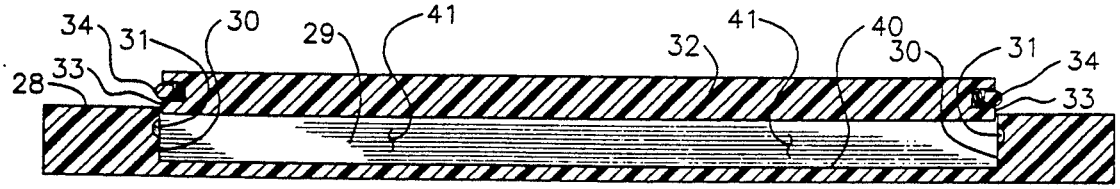
FIG. 6 is an orthographic view, taken along the lines 6—6 of FIG. 5 in the direction indicated by the arrows.

The FIG. 5 indicates the table 24 having a top surface slot 29 of a predetermined length directed into the top surface 28 in adjacency to the support table second side in a parallel relationship. An abutment block 32 of said predetermined length is received within the slot 29, with the slot having slot end walls 30, with each end wall 30 having an end wall recess 31. The slot 29 includes a slot floor 40 having a plurality of springs 41 mounted to the floor 29 and to the abutment block 32 to normally bias the abutment block in a spaced orientation relative to the floor, with the abutment block projecting above the top surface in the first position. The abutment block is received within the slot, with the abutment block's top wall in coplanar alignment with the support table top surface 28 in a second position. The abutment block permits for the positioning of books and the like thereon when the support table is tilted relative to the support table 15. The abutment block 32 includes block end walls 33, each having a locking sphere 34 spring biased in a projecting orientation relative to an associated block end wall 33 for reception within a slot end wall recess 31 to secure the abutment block within the slot in the second position.

Figure 7:
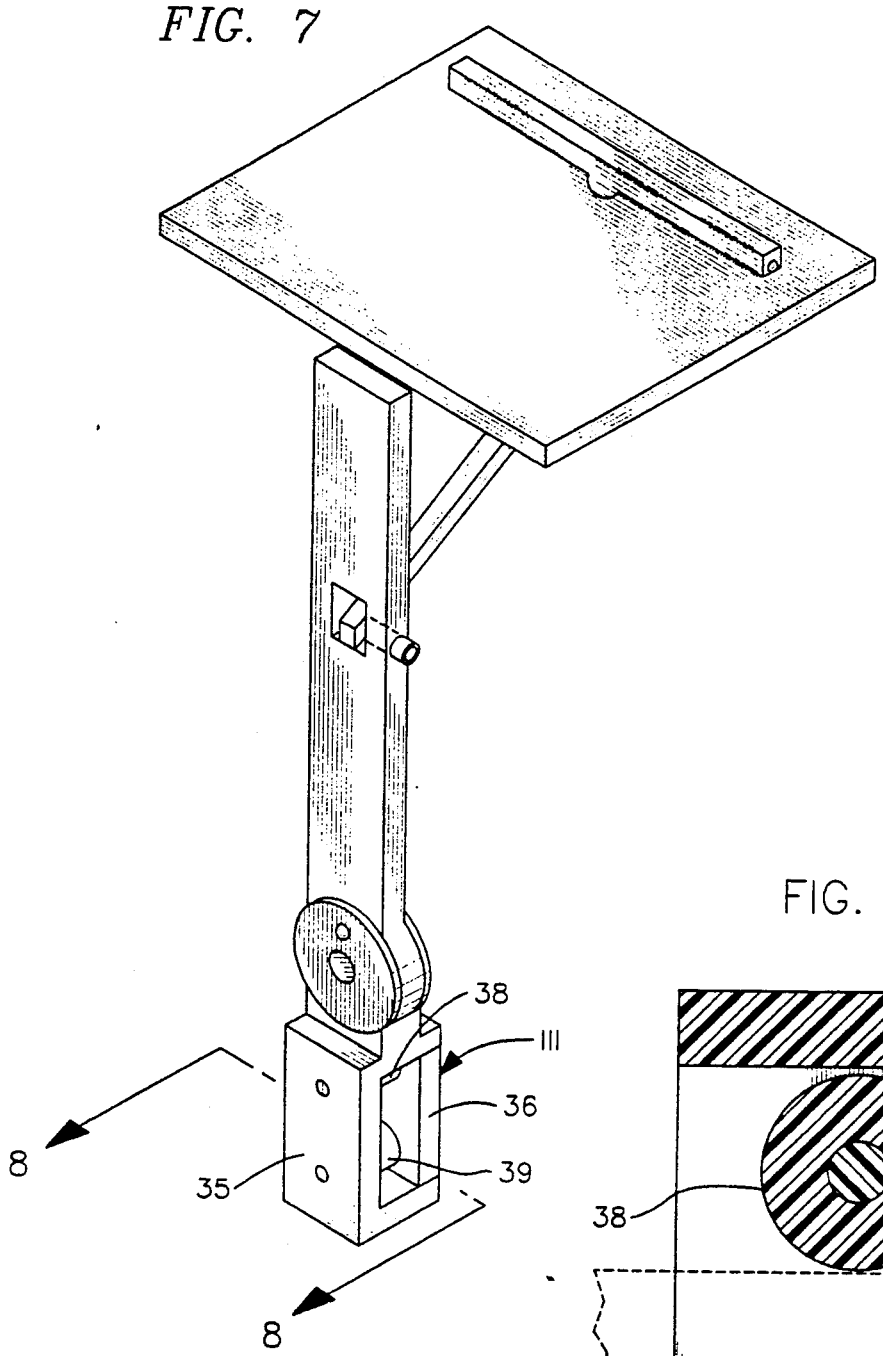
FIG. 7 is an isometric illustration of the invention employing a modified support housing to slidably receive a bed rail therethrough.
Figure 8:
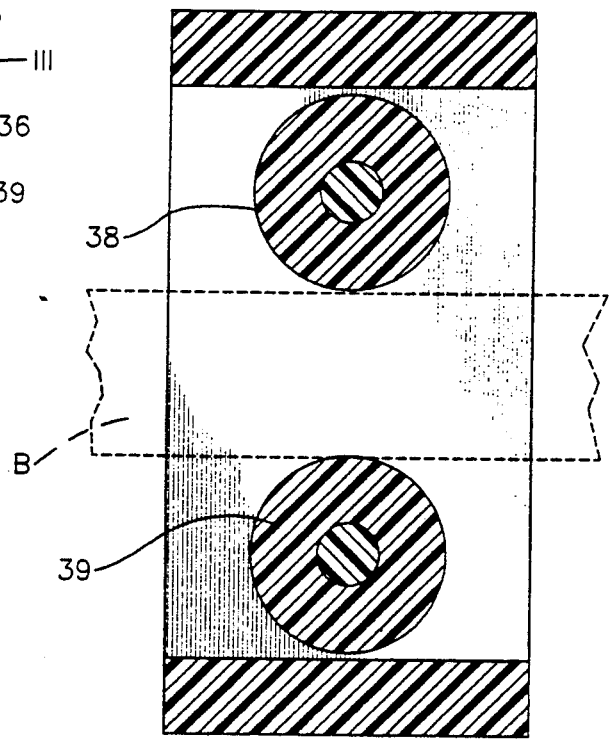
FIG. 8 is an orthographic view, taken along the lines 8—8 of FIG. 7 in the direction indicated by the arrows.

The FIG. 7 indicates the use of a support housing 111 in lieu of the support base plate 11. The support housing 11 is formed with a housing first side wall 35 parallel to a housing second side wall 36, in turn oriented parallel to the support plate 15, with the support plate 15 oriented intermediate the first and second side walls 35 and 36, with the support plate 15 and the bifurcated mount 12 positioned above the support housing 111 as indicated. A through-extending bore 37 is directed through the support housing intermediate the first and second side walls 35 and 36, with the through-extending bore 37 including respective first and second rollers 38 and 39 rotatably mounted intermediate the first and second walls, and the first and second rollers 38 and 39 having a spacing therebetween to receive a bed rail "B" therebetween to permit sliding of the organization relative to an associated bed rail. Each of the first and second rollers 38 and 39 include respective first and second roller axles orthogonally oriented relative to the first and second side walls 35 and 36 for the mounting of the first and second rollers as indicated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bedside table apparatus for mounting to a bed, wherein the apparatus comprises, a support base plate member, the support base member includes mounting means for mounting the support base member to the bed, and the support base plate member having a first end spaced from a second end, the first end including a bifurcated mount, the bifurcated mounting having a first mounting plate spaced from a second mounting plate, and a support plate, the support plate including a support plate lower end, wherein the support plate lower end includes a cylindrical hub received between the first mounting plate and the second mounting plate, and the hub having a hub axle orthogonally directed through the first mounting plate and the second mounting plate, and rotatably mounting the support plate to the bifurcated mount, the support plate mounted to be moved from a first position longitudinally aligned with the support base member to a second position angularly displaced relative to the support base member, and the support plate having support plate upper end, and a support table, the support table having a hinge hingedly mounting the support table to the support plate upper end, and the support table having a first side having the hinge secured thereto, the support table having a second side, and the support table having a top surface spaced from a bottom surface, the bottom surface having a lug fixedly mounted to the bottom surface in adjacency to the second side, the lug including a link member, the link having a first end pivotally mounted to the lug, and the support plate having a support plate bore, with the link including a link second end slidably received through the bore, and lock means mounted to the support plate for selectively locking the link within the bore.

2. An apparatus as set forth in claim 1 wherein the lock means includes a lock rod directed through the support plate intersecting the bore and in contiguous communication with the link for securing the link relative to the bore.

3. An apparatus as set forth in claim 2 wherein the hub includes a hub socket and a lock pin reciprocatably mounted within the hub socket, and a spring interposed between the lock pin and the hub socket, and the lock pin received through a lock pin bore, with the lock pin bore directed through the first mounting plate to lock the support plate to the support base member in the first position.

4. An apparatus as set forth in claim 3 wherein the support base member includes a housing having a first side wall spaced from a second side wall, wherein the first side wall and the second side wall are oriented orthogonally relative to the hub axle, and the first side wall and the second side wall include a through-extending bore.

5. An apparatus as set forth in claim 4 including a first roller and a second roller positioned within the through-extending bore, with the first roller having a first roller axis, and the second roller having a second roller axis, with the first roller axis and the second roller axis parallel relative to one another and to the hub axle, with the first roller and the second roller having a spacing therebetween to receive a bed rail between the first roller and the second roller in a rotative relationship between the bed rail and the first roller and the second roller.

* * * * *